US009854898B2

(12) United States Patent
Whitley

(10) Patent No.: US 9,854,898 B2
(45) Date of Patent: Jan. 2, 2018

(54) SUSPENSION THERAPY APPARATUS

(71) Applicant: Megan E Whitley, Scottsdale, AZ (US)

(72) Inventor: Megan E Whitley, Scottsdale, AZ (US)

( * ) Notice: Subject to any disclaimer, the term of this patent is extended or adjusted under 35 U.S.C. 154(b) by 226 days.

(21) Appl. No.: 15/017,097

(22) Filed: Feb. 5, 2016

(65) Prior Publication Data

US 2016/0228319 A1 Aug. 11, 2016

Related U.S. Application Data

(60) Provisional application No. 62/112,905, filed on Feb. 6, 2015.

(51) Int. Cl.

| | |
|---|---|
| ***A45F 3/22*** | (2006.01) |
| ***A63G 9/00*** | (2006.01) |
| ***A61G 7/10*** | (2006.01) |
| ***A45F 3/26*** | (2006.01) |
| *A61H 37/00* | (2006.01) |

(52) U.S. Cl.

CPC ..... *A45F 3/22* (2013.01); *A45F 3/26* (2013.01); *A61G 7/1015* (2013.01); *A61G 7/1044* (2013.01); *A61G 7/1051* (2013.01); *A61H 37/00* (2013.01)

(58) Field of Classification Search

CPC . A45F 3/22; A45F 3/26; A47C 3/0255; E04H 15/04; A63G 9/00; A61H 3/00; A61H 3/008; A63B 12/00181; A63B 22/00

See application file for complete search history.

(56) References Cited

U.S. PATENT DOCUMENTS

| | | | | |
|---|---|---|---|---|
| 3,261,607 A * | 7/1966 | Horowitz | A63G 9/00 | 297/463.2 |
| 3,897,056 A * | 7/1975 | Hock | A63G 9/00 | 238/14 |
| 3,937,463 A * | 2/1976 | Soisson | A63G 9/00 | 24/129 D |
| 4,017,071 A * | 4/1977 | Wright | A63G 9/00 | 472/118 |
| 4,101,165 A * | 7/1978 | Hammer | A47C 3/0255 | 297/273 |

(Continued)

OTHER PUBLICATIONS

European Federation of Professional Circus Schools, Introduction to Aerial Straps, http://www.fedec.eu/en/articles/419-aerial-straps, 2012.

*Primary Examiner* — Eric J Kurilla

(74) *Attorney, Agent, or Firm* — Whitley Legal Group, P.C.; AnnMarie W. Whitley

(57) ABSTRACT

A suspension therapy apparatus features a hammock formed from a rectangular textile modified at its long edges with a first and second plurality of attachment loops. The hammock suspends from a support with suspension hardware that permits the hammock to swing back and forth and rotate 360 degrees. One or more safety straps weave through and removably attach to one or more loops among the pluralities of attachment loops on the textile according to specified patterns to accommodate patients who wish to sit or lay in the hammock and to prevent patients from falling or becoming entangled in the straps. Additional optional features include a pulley system that allows a therapist to raise and lower the hammock as needed, an integrated or removable seat, and anchor points for securing the hammock with ties to fixed points on the ground or frame.

16 Claims, 12 Drawing Sheets

(56) References Cited

U.S. PATENT DOCUMENTS

D263,663 S * 4/1982 Moreau ..... 5/120
4,524,966 A * 6/1985 Shannon ..... A47D 13/105 297/273
4,550,456 A * 11/1985 Allen ..... A47D 9/02 5/102
4,575,073 A * 3/1986 Thacker ..... A63G 9/00 297/273
4,922,860 A 5/1990 Hutchings
5,161,522 A 11/1992 Clevenger
5,197,925 A * 3/1993 Cunard ..... A63G 9/00 297/273
5,197,926 A * 3/1993 Cunard ..... A63G 9/00 403/128
5,511,258 A * 4/1996 Barr, Sr. ..... A47D 9/00 297/273
5,531,656 A * 7/1996 Varghese ..... A47D 13/105 297/274
5,659,906 A * 8/1997 Nickell ..... A45F 3/24 5/120
5,673,444 A * 10/1997 Middendorf ..... A45F 3/24 5/120
5,839,965 A * 11/1998 Mullins ..... A47D 13/105 297/485
5,860,175 A * 1/1999 Saiki ..... A45F 3/26 5/111
5,898,960 A * 5/1999 Hill ..... A63B 29/00 5/120
5,944,381 A * 8/1999 Nguyen ..... A47D 13/105 297/281
5,971,480 A * 10/1999 Maschke ..... A47C 15/008 297/273
7,255,666 B2 8/2007 Cardenas
7,468,023 B2 12/2008 Wu et al.
8,038,584 B1 * 10/2011 Pruessner ..... A61H 1/02 482/143
8,454,450 B1 * 6/2013 Cordray ..... A63G 9/00 472/118
8,651,971 B1 * 2/2014 Chen ..... A63G 9/00 273/317
D702,449 S * 4/2014 Puotiniemi ..... D6/347
9,345,975 B2 * 5/2016 Xu ..... A63G 9/14
9,451,827 B1 * 9/2016 Ciraolo ..... A63G 9/00
2003/0140417 A1 * 7/2003 Huff ..... A45F 3/22 5/120
2004/0116195 A1 * 6/2004 Lee ..... A47C 3/0255 472/118
2004/0127339 A1 * 7/2004 Finn ..... A63B 21/00181 482/140
2005/0144719 A1 * 7/2005 Branch, III ..... A45F 3/22 5/122
2005/0188460 A1 * 9/2005 O'Brien ..... A45F 3/22 5/121
2006/0000499 A1 * 1/2006 Livacich ..... E04H 15/001 135/90
2006/0052222 A1 * 3/2006 Cardenas ..... A61H 1/0229 482/96
2006/0189453 A1 8/2006 Leblond
2007/0049391 A1 * 3/2007 Groff ..... A61F 13/84 472/125
2008/0300512 A1 12/2008 Choi
2010/0181142 A1 7/2010 Gerner et al.
2011/0124477 A1 * 5/2011 Davis ..... A63B 21/068 482/143
2013/0327592 A1 12/2013 Gerner et al.
2014/0116485 A1 * 5/2014 Shirley-Smith ..... E04H 15/04 135/90
2014/0252826 A1 * 9/2014 Smith ..... A63G 9/00 297/250.1
2014/0274430 A1 * 9/2014 Giordano ..... A63G 9/00 472/118
2016/0023051 A1 * 1/2016 Lauener ..... A61H 1/0229 482/143
2016/0242539 A1 * 8/2016 Paya ..... A45F 3/22
2017/0225085 A1 * 8/2017 Najar ..... A63H 3/36
2017/0295912 A1 * 10/2017 Meillan ..... A47D 7/04

* cited by examiner

SUSPENSION THERAPY APPARATUS

CROSS-REFERENCE TO RELATED APPLICATIONS

This application claims the benefit of co-pending provisional U.S. application No. 62/112,905 filed Feb. 6, 2015.

FIELD OF INVENTION

This invention relates to physical therapy and exercise equipment. More particularly, this invention relates to a suspension therapy apparatus that can be used by disabled persons or any person needing additional safety measures.

BACKGROUND

Movement therapy and yoga are promising and relatively new areas of treatment for physically disabled persons and for persons with conditions such as autism, depression, chronic illnesses, dementia, and anxiety. Due to the current lack of safe and adequate support devices that facilitate movement and stretching, however, movement therapy and yoga are largely unavailable or impractical.

Movement or dance therapy has been shown through research to provide significant benefits for persons suffering from various conditions or disorders. For people suffering from schizophrenia, depression, stroke, anxiety, and eating disorders, dance therapy has been shown to improve physical, psychological, and cognitive functioning as well as improve body image and increase relaxation. Unfortunately, however, dance therapy has primarily been tested on people with psychological problems rather than physical disabilities due to the lack of a safe and supportive apparatus to assist the therapists. Because movement therapy has been helping people who suffer from such a wide variety of illnesses or conditions, it is likely that it will similarly benefit physically disabled persons as well.

One type of movement therapy has been tested on physically disabled persons with a positive outcome. Specifically, suspension therapy has been investigated as a method of treating paraplegics. Using a new frame that supports a suspension harness positioned over a treadmill, some paraplegics have regained partial mobility of their limbs after practicing a repetitive walking motion. This suggests the many possibilities of therapies available with suspension devices and the great improvements to the patients' condition that work in this area could yield. It would be useful to explore further.

Like movement therapy, the general benefits of yoga and aerial yoga for both handicapped and non-handicapped people are also being actively explored. Both types of yoga have been shown to stretch, work core muscles, and relieve stress. Aerial yoga has been increasing in popularity in particular due to the increase in safety, accessibility, and fun that it provides. Additionally, yoga is shown to provide psychological benefits for all people who practice it, such as giving the students more relaxation and also an energetic rush. Finally, practicing a modified form of yoga has recently been shown to help people suffering from spinal cord injuries. The people who are a part of this movement maintain that yoga is for everyone and that even people who cannot practice traditional yoga still can, and should, enjoy its benefits. Therefore, it is useful to develop an improved apparatus to help the handicapped easily utilize these therapy techniques.

Many different safety and functional considerations should be considered for a practical and safe suspension therapy apparatus. First, it should provide freedom of movement and mobility the patient can have while using the apparatus. The apparatus should be able to swing in all directions and be able to rotate without becoming tangled. Also, the patient should not have too many safety straps holding them in place such that it becomes difficult to do the exercises or movements necessary. Upper body movement should remain unrestrained. Second, the apparatus should be adaptable for use with patients of different heights and with different disabilities. The patient using the apparatus should be able to modify the apparatus based on their specific needs in order to balance the amount of support they need from the apparatus with the amount of mobility they want to feel when using it.

There are also many safety and related considerations to consider. The apparatus should be strong enough to support patients of any weight or be adaptable depending on the amount of weight it must support. Also, the patients should have a safe way to get in and out of the apparatus and to transition between exercises and stretches. While this can be done with the assistance of a therapist, it should be practical and not dangerous for either the therapist or the patient. Additionally, it is necessary to look at the shifting of the apparatus while in use. The apparatus should be secure and safe for all exercises. It should reduce or prevent uncomfortable or dangerous sliding and rubbing. Last, if the patient were to have any complications while using the apparatus, the therapist should be able to quickly stop and release them from the apparatus.

Currently available therapy swings and apparatuses for disabled people are inadequate, however because they do not allow for both freedom of movement and stability. One such swing features a fixed rotation point that has a bar to keep the two separate sides of the hammock from tangling. While this provides a full range of rotation, it does not allow the patient to swing in all directions. Additionally, it does not support for the patient in a manner that allows him to easily and safely do many exercises or yoga stretches. Another design is a simple barrel on which the patient can sit and swing. The barrel provides almost no support and is difficult to use with patients who do not have lower body mobility. A third apparatus is shaped like a shallow bowl and is suspended from one point. Because the bowl is rigid, it does not allow the patient to easily practice yoga or many physical therapy exercises. A fourth swing apparatus is shaped like a soft taco and has two points of connection to the frame. The soft taco can only be used while lying down, however, and prevents the patient from having full mobility. Finally, traditional aerial yoga hammocks are also available, but they lack any safety features or restraints, which makes them unsafe for many disabled persons and for persons suffering from conditions where extra support is needed.

Additional currently available suspension devices or swings targeting handicapped persons specifically include a swing shaped similar to a chair with a harness-like buckle. While it allows a patient to swing back and forth without risk of falling out of the chair, it does not allow the patient to do much else. Another swing apparatus that can possibly accommodate a patient in a wheel chair has a simple plywood platform attached at a single point to the frame. Unfortunately, it only facilitates a small amount of movement before encountering safety concerns. Additionally, the patient must remain in his wheelchair while using the device.

Accordingly, it would be desirable to provide a suspension therapy apparatus that can safely accommodate a disabled person. Moreover, it would be desirable to provide a suspension therapy apparatus that allows for great freedom of movement and that is highly customizable depending on a person's height, weight, and safety needs. Additionally, it would be desirable to provide a suspension therapy apparatus that supports a person who wishes to practice physical therapy exercises, occupational therapy exercises, yoga exercises and poses, and other forms of exercise or dance movement. Finally, it would be desirable that the safety features be quickly removable in the event of an emergency.

SUMMARY OF THE INVENTION

The apparatus features a rectangular textile such as a traditional yoga silk that is modified with a first and second plurality of attachment loops centered along its long edges and is suspended from a support frame. The rectangular textile forms a hammock when it is suspended at suspension points located along the textile's short edges. The suspension points can be integrated with or fixed to the textile or they can be removably attached such as by tying each of the opposite ends to O-rings using a series of overhand knots. The hammock attaches to an overhead mount with suspension hardware such as a series of swivels, rings, loops, and latches that allow the hammock to swing back and forth and to rotate 360 degrees. For example, the O-rings attach with carabiners, a swivel, a spreader plate, and optional daisy chains to a swing hanger mounted on a support frame. One or more safety straps weave through and removably attach to one or more loops among the pluralities of attachment loops on the textile according to specified patterns to accommodate patients who wish to sit or lay in the hammock and to prevent patients from falling or becoming entangled in the straps. The apparatus is accessible to paraplegics with the help of a therapist, includes safety straps to prevent falls, and allows for significant range of motion. The safety straps are repositionable to accommodate different users and able to be removed quickly in case of emergency or if the patient does not need the maximum amount of support. Additional features can also be present such as a pulley system that allows a therapist to raise and lower the hammock as needed, an integrated or removable seat, and anchor points for securing the hammock with ties to fixed points on the ground or frame.

DETAILED DESCRIPTION OF THE INVENTION

The embodiments disclosed herein are illustrated by way of example and not by way of limitation in the figures of the accompanying drawings in which like references indicate similar elements. It should be noted that references to "an" or "one" embodiment in this disclosure are not necessarily to the same embodiment, and they mean at least one. Also in this section we shall explain several preferred embodiments with reference to the appended drawings. Whenever the shapes, relative positions and other aspects of the parts described in the embodiments are not clearly defined, the scope of the embodiments is not limited only to the parts shown, which are meant merely for the purpose of illustration. Also, while numerous details are set forth, it is understood that some embodiments may be practiced without these details. In other instances, well-known structures and techniques have not been shown in detail so as not to obscure the understanding of this description. Additionally, in the following description, while specific sizes and strength ratings are suggested, similar items having the same features may be substituted with different strength ratings. In general, the required strength rating of the components need only be sufficient to support a person suspended in the apparatus. For example, for a 80 lbs. child, the strength ratings must be 80 lbs. or greater. For a 250 lbs. adult, the strength ratings must be 250 lbs. or greater.

Figure 1:
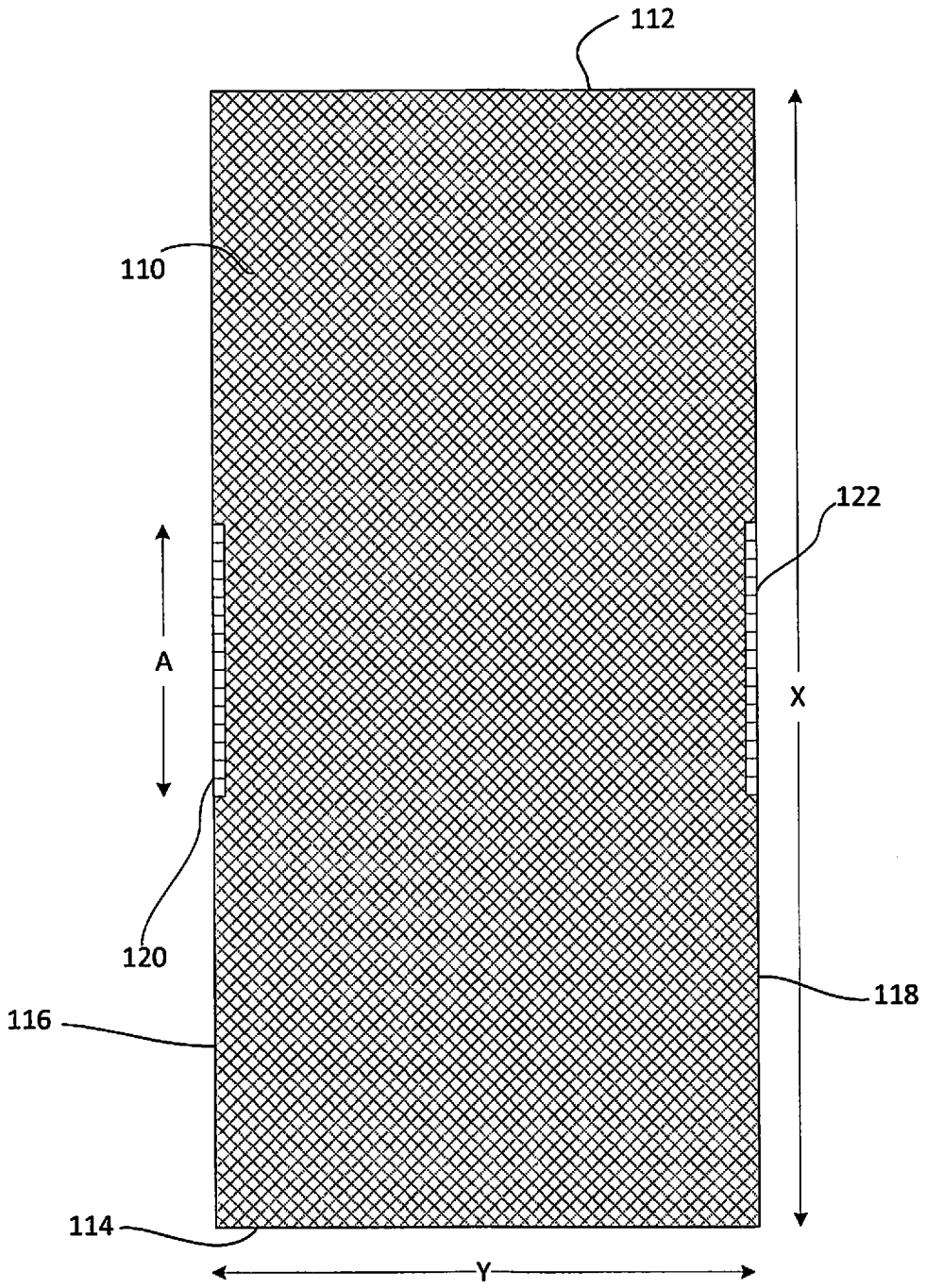
FIG. 1 is an illustration of the textile of the present invention.
Figure 5:
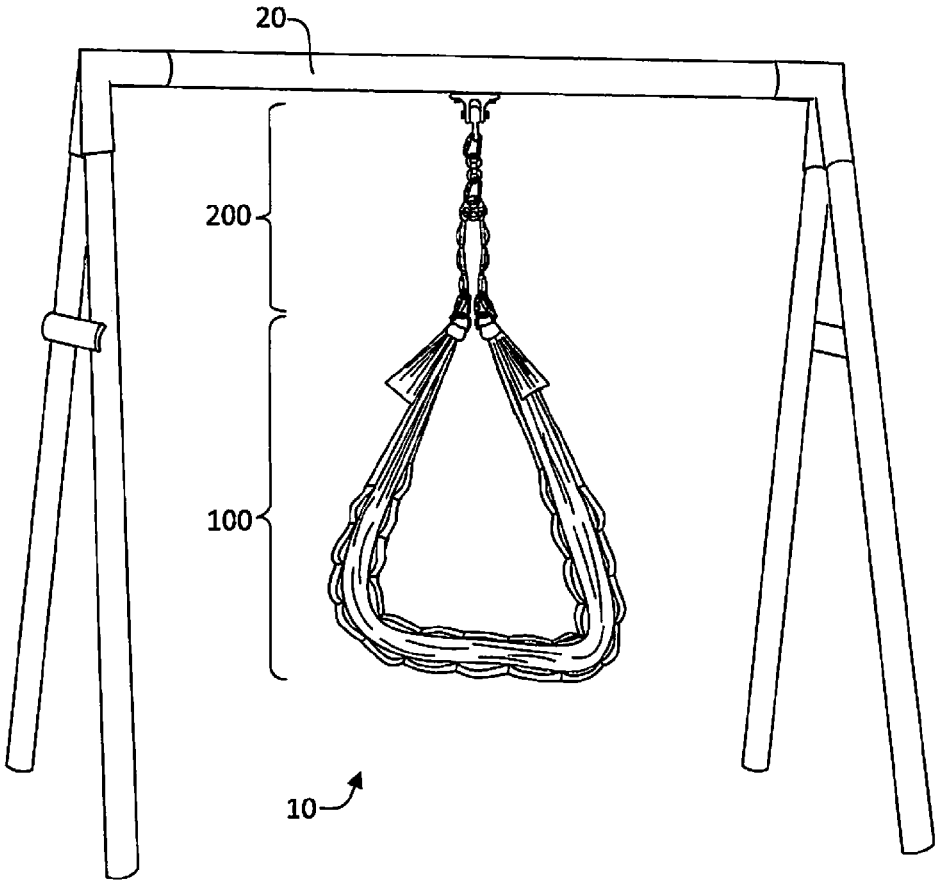
FIG. 5 is a perspective view of the suspension apparatus of the present invention as it is suspended from a frame.

As shown in FIGS. 1 and 5, an improved suspension apparatus 10 can be used for physical therapy, aerial yoga, movement therapy, kinesiotherapy, or occupational therapy. Apparatus 10 comprises a hammock 100 and suspension hardware 200 and can be suspended from a support structure 20. Additionally, apparatus 10 optionally further comprises a pulley system 300 for raising and lowering the hammock 100 and suspension hardware 200. Hammock 100 cooperates with one or more safety straps 150, 152, 160, and 162 to provide support for people who are disabled or may require additional safety precautions or support.

As shown in FIG. 1, hammock 100 is constructed using a large textile 110 such as a traditional aerial yoga silk that can be formed into a hammock shape. Any material can be used for textile 110, however, provided it can be formed into a hammock shape by gathering its short edges or sides 112, 114. Preferably, textile 110 is a resilient material with low to moderate stretch. FIG. 1 illustrates the preferred shape of textile 110, which is rectangular with two long edges or sides 116 and 118 having a length X and two short edges or sides 112, 114 having a length Y. Textile 110 has a first surface and a second surface (not labelled). Preferably, textile 110 comprises a low stretch nylon tricot material with long sides 116, 118 of about 252 inches and short sides 112, 114 of about 120 inches, which allows the short sides 112, 114 of textile 110 to be gathered and tied in knots as needed. Additionally, preferably textile 110 has a strength rating suitable for accommodating patients of different weights. For example, a strength rating of at least 350 lbs. is preferred for accommodating both children and adults weighing up to 350 lbs. Many traditional aerial yoga silks have a strength rating of over 1600 lbs. (7.12 kN).

Figure 2:
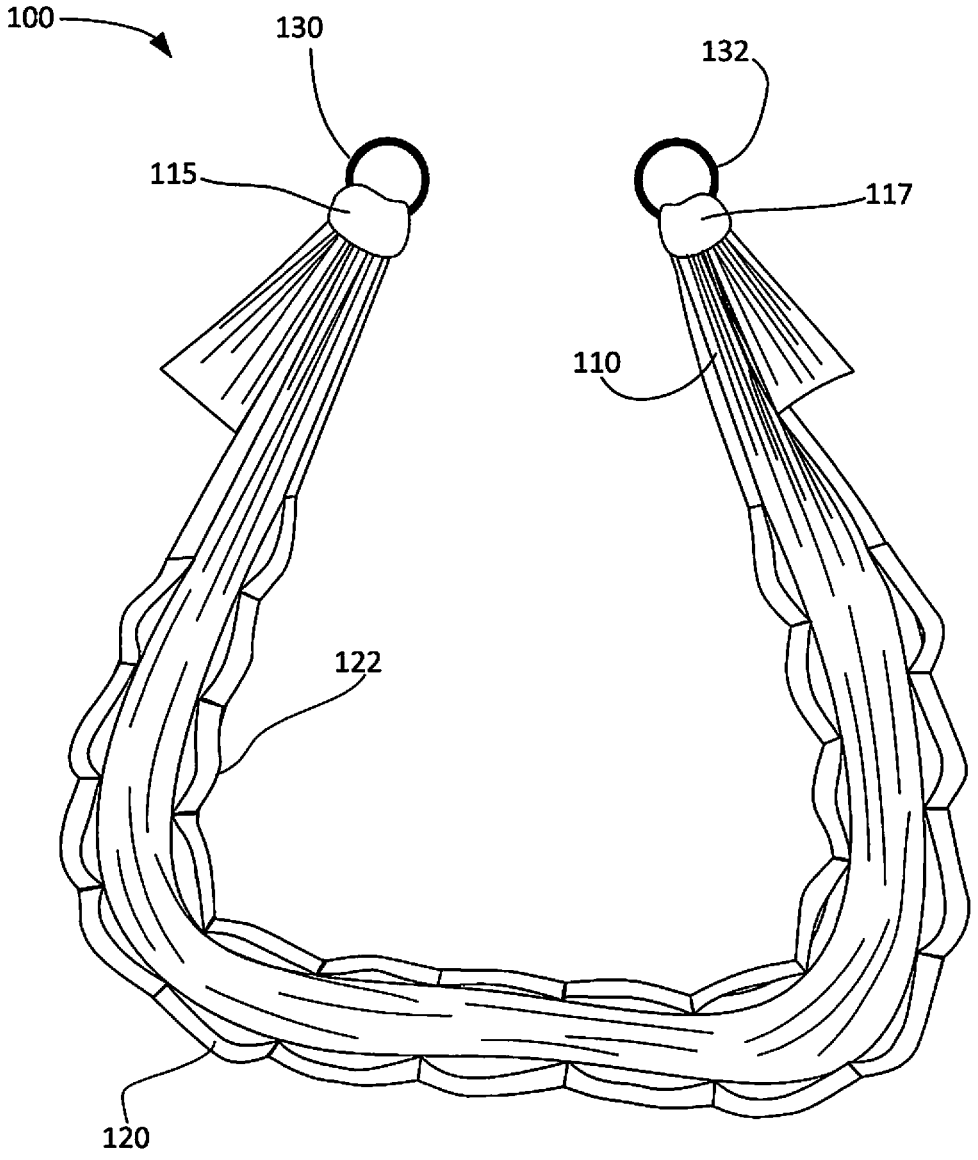
FIG. 2 is a perspective view of the textile configured as a hammock according to the present invention.

Textile 110 is modified to include a first plurality of attachment loops 120 and a second plurality of attachment loops 122 on opposing long edges 116 and 118, respectively as shown in FIG. 1. First and second plurality of attachment loops 120, 122 are generally centered along the long sides 116, 118 of the textile and comprise several individual loops. Preferably, each plurality of attachments loops comprises about 10-20 loops so that there are several attachment points for the safety straps and to increase the options for accommodating people of all heights and disabilities. Also preferably, each plurality of attachment loops has minimal space between each individual loop as shown in the Figures. The pluralities of attachment loops are substantially centered along the long edges 116 and 118 of textile 110 so that when it is shaped as a hammock the loops are located along the front and back sides and bottom of the textile as shown in FIG. 2. Each plurality of attachment loops has a length A, which is preferably at least ⅕ of the total length of the longest side of textile 110. As shown in FIG. 1, each plurality of attachment loops is 60 inches long, which is about ¼ of the total length of the longest side of textile 110.

The first and second plurality of attachment loops 120, 122 can be formed of any material that is strong enough to bear the weight of a person who may need to support himself by safety straps attached to the loops. Additionally, first and second plurality of attachment loops 120, 122 preferably are formed from somewhat flexible material in order to increase a patient's comfort when sitting or lying in hammock 100. For example, a 60 inch by 1 inch poly-filament webbing daisy chain with a strength rating of 400 lbs. (1.78 kN) is flexible enough to be comfortable when in use and strong enough to withstand the weight of the patient. Using a daisy chain arrangement is particularly convenient because it includes a plurality of attachment loops and can be easily centered and attached to textile 110. Preferably first and second plurality of attachment loops are permanently attached to textile 110 such as with sewing, adhesion, bonding, or any other method of attaching two textiles together. Optionally, first and second plurality of attachment loops 120, 122 also can be integrally formed with textile 110 and further optionally may include reinforcement materials, stitching, or the like to increase the durability and performance of any integrally formed first and second plurality of attachment loops 120, 122. Additional methods of permanently securing first and second plurality of attachment loops 120, 122 to textile 110 will be known to those skilled in the art. First and second plurality of attachment loops 120, 122 can be attached on the first surface of textile 110, the second surface of textile 110, or directly on the edges 120 and 122 of textile 110.

Hammock 100 further cooperates with first and second suspension points 130, 132 located along the textile's short edges 112, 114. Suspension points 130, 132 can be integrated with, fixedly attached to, or removably attached to textile 110. FIGS. 2-5 illustrate a preferred method of removably attaching textile 110 to suspension points 130, 132 where suspension points 130, 132 are O-rings and where each of the opposite ends 112, 114 are gathered and tied to the O-rings using a series of overhand knots 115, 117. Additional methods of permanently securing ends 112, 114 of textile 110 to suspension points 130, 132 such as with sewing, adhesive, or bonding the suspension point with textile 110 are also acceptable. Further, additional methods of temporarily securing ends 112, 114 of textile 110 to suspension points 130, 132 such as snaps, clasps, clips, ties, buttons, and zippers are also acceptable. It is important that the method of securing textile 110 to suspension points 130, 132 is significantly secure and strong, however, so that when a patient is using hammock 100, textile 110 is not at risk of detaching from suspension points 130, 132. For example, using a series of overhand knots 115, 117 to tie textile 110 to suspension points 130, 132 that are 3 inch diameter stainless steel O-rings with a strength rating of 5000 lbs (22.2 kN) is sufficient. O-rings with higher or lower strength ratings also are sufficient as long as they can support the weight of the patient.

Figure 3:
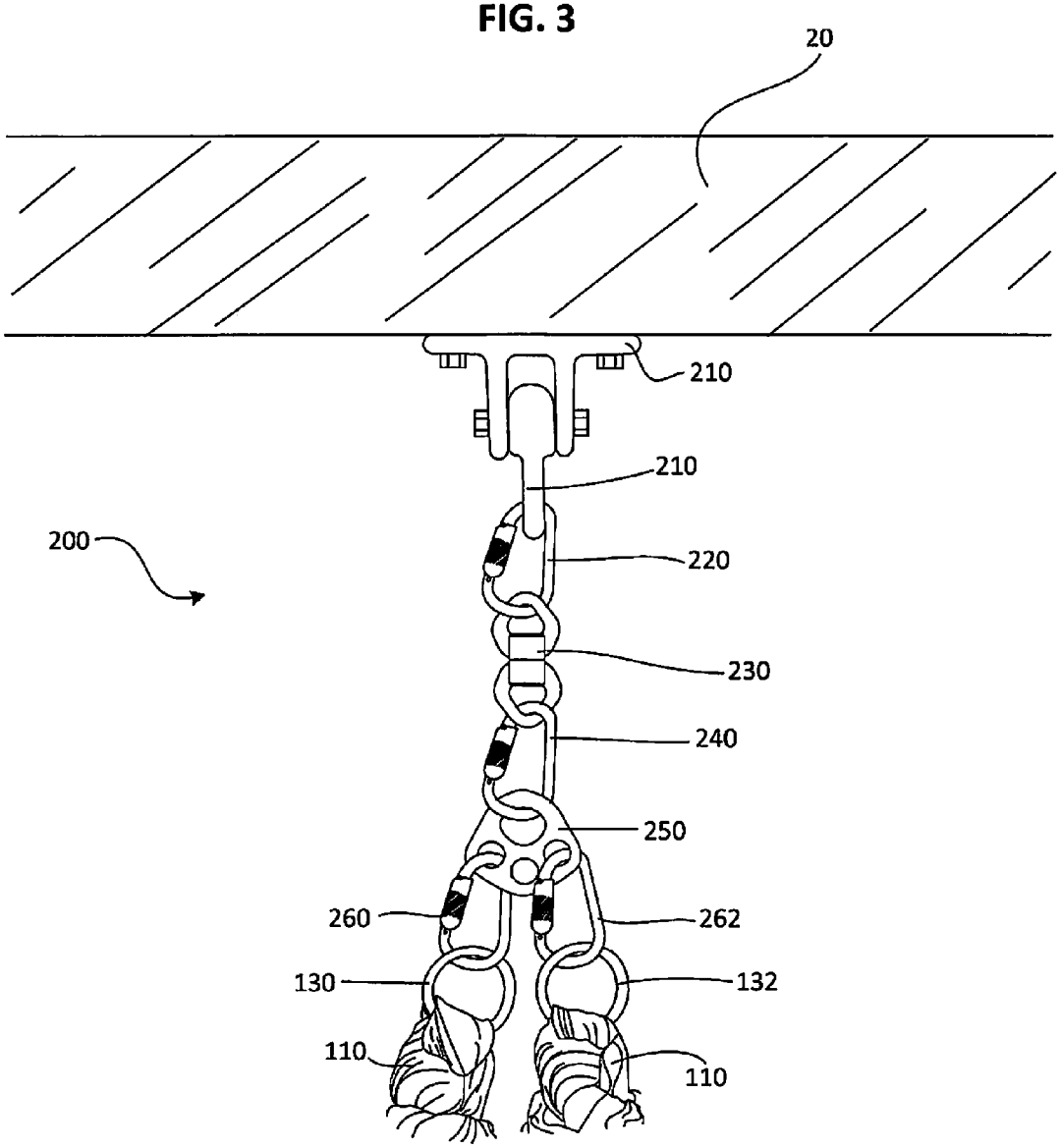
FIG. 3 is a perspective view of hardware for suspending the hammock according to the present invention.
Figure 4:
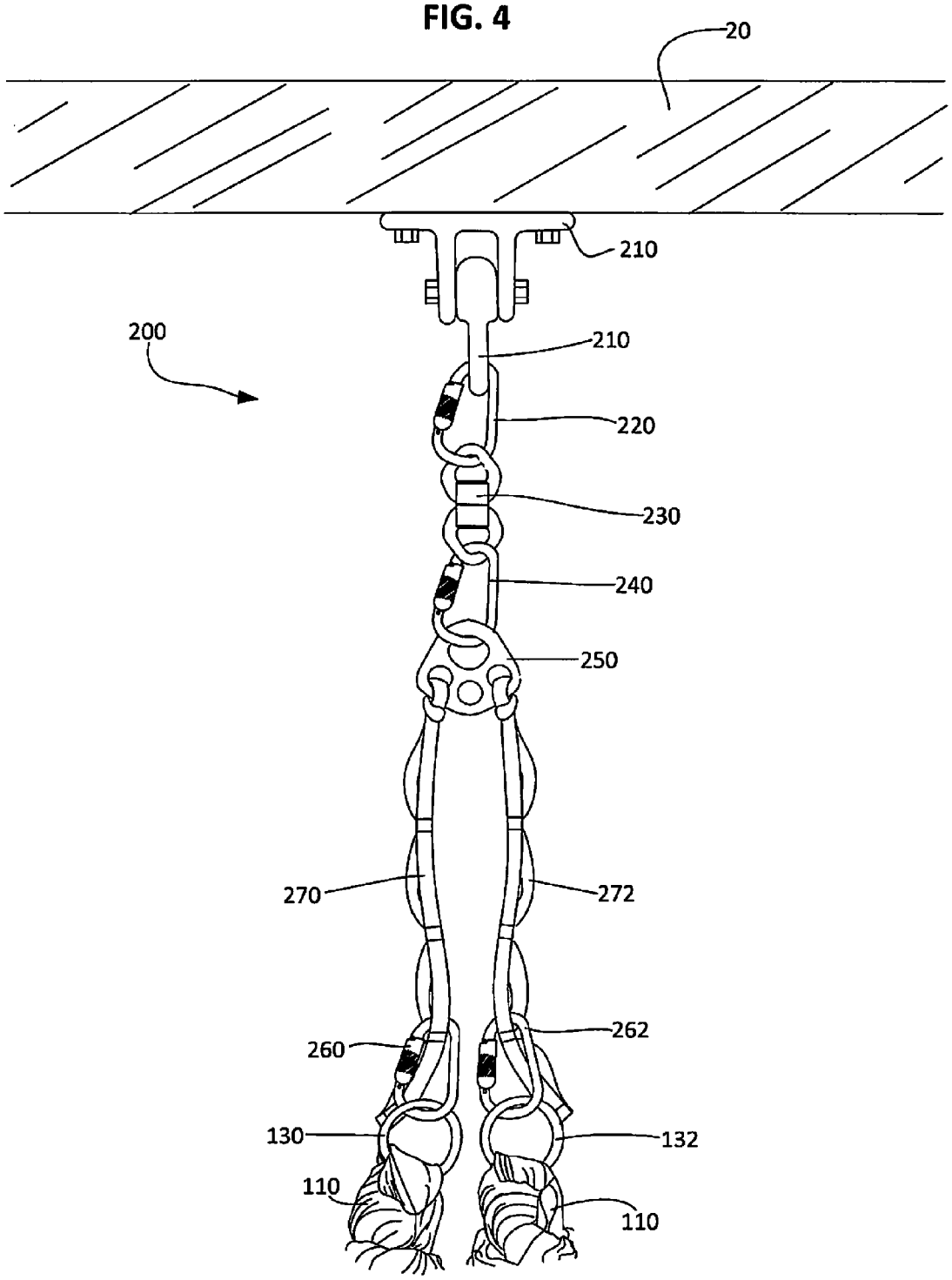
FIG. 4 is a perspective view of alternate hardware for suspending the hammock according to the present invention.

Hammock 100 attaches to an overhead mount 205 with suspension hardware 200 that allows hammock 100 to swing back and forth and to rotate 360 degrees. The overhead mount 205 attaches to a support 20 such as a frame or beam. Mount 205 can be any type of clamp or mount that attaches to support 20 that includes swing or swivel hardware. FIGS. 3-5 illustrate a mount 205 that includes swing hardware 210 such as a swing hanger, which is preferred. Swing hardware 210 allows hammock 100 to swing back and forth when attached with suspension hardware 200 under the support 20. A suitable overhead mount 205 with swing hardware 210 for use with an A-frame wood support is a 3 inch×8 inch×5 inch galvanized metal commercial grade swing hanger with a 350 lbs (1.56 kN) strength rating that attaches to support 20 with lag screws and washers.

Many types of supports 20 are readily available that are suitable for supporting swings, yoga hammocks, and other currently available suspension devices. All of the supports suitable to support a traditional swing or yoga hammock are also be suitable for the improved suspension apparatus described herein. Appropriate supports 20 include, for example, a tripod frame with curved legs that rests on a circular base and an alternative tripod frame with straight legs and no base. Appropriate supports 20 also include a traditional swing set frame or a modified version of the traditional A-frame swing set frame and a C-stand frame that has a curved overhanging support attached to a circular base. Finally, suspension apparatus 10 also may be suspended from an I-beam or a traditional beam using a variety of different clamps and mounts.

Hammock 100 attaches to overhead mount 205 with suspension hardware 200. Suspension hardware 200 includes any individual or combination of hardware that allows hammock 100 to be supported at its two suspension points 130, 132, allows a substantial degree of rotation, and attaches to overhead mount 205 and preferably to an overhead mount with swing hardware 210. Preferably, where suspension hardware 200 attaches to swing hardware 210, suspension hardware 200 includes a swivel to additionally allow 360 rotation of hammock 100. For use with swing hardware 210, FIG. 3 illustrates a first example of a preferred combination of hardware for suspension hardware 200, which includes a swivel 230, several carabiners 220, 240, 260, 262, and a spreader plate 250. Specifically, suspension points 130, 132 of textile 100 attach to openings (not labelled) on spreader plate 250 with carabiners 260, 262, spreader plate 250 attaches to swivel 230 with carabiner 240, and swivel 230 attaches to swing hardware 210 with carabiner 220. Swing hardware 210 allows hammock 100 to swing back and forth, swivel 230 facilitates rotation of hammock 100, spreader plate 230 provides two attachment points for suspension points 130, 132 so that hammock 100 does not tangle, and carabiners 220, 240, 260, 262 allow for easy customization and assembly. One or more daisy chains 270, 272 can also be added, as shown in FIG. 4, to increase the overall length of suspension hardware 200. Where daisy chains 270, 272 are included, preferably they are positioned between spreader plate 250 and carabiners 260, 262 to allow for a greater degree of customization as needed. Daisy chains 270, 272 can attach to spreader plate 250 with clips or carabiners, or they can connect with ties or loops as shown in FIG. 4. Suitable carabiners for carabiners 220, 240, 260, 262 include screw gate carabiners, and optionally carabiners 220, 240, 260, 262 are 4.5 inches by 2.5 inches in size with a 8992 lbs. strength rating (40-50 Kn). A suitable swivel for swivel 230 is one comprised of aircraft aluminum with stainless steel bearings and a size of approximately 4.5 inch×2 inch×1.25 inch with a strength rating of 7868 lbs. (35 kN). A suitable spreader plate for spreader plate 250 is also comprised of aircraft aluminum, includes two or more openings for attachments, and is sized approximately 3.25 inch×3 inch×0.25 inch, with a strength rating of 6744 lbs. (30 kN). Suitable daisy chains for daisy chains 270, 272 include 4 foot×0.75 inch nylon webbing daisy chains with a 5000 lbs. (22 kN) strength rating. With respect to the suspension hardware 200, while specific sizes and strength ratings are suggested, similar items having the same features may be substituted with different strength ratings. In general, the required strength rating of the components need only be sufficient to support a person suspended in the apparatus. For example, for a 80 lbs. child, the strength ratings must be 80 lbs. or greater. For a 250 lbs. adult, the strength ratings must be 250 lbs. or greater.

One or more safety straps 150, 152, 160, 162 weave through and attach to one or more of the loops among the plurality of the attachment loops 120, 122 on textile 110 according to specified patterns to accommodate patients who wish to sit or lay in the hammock and to prevent patients from falling or becoming entangled in the straps. Each of safety straps 150, 152, 160, 162 includes strap connectors at opposing ends. As shown in FIGS. 6-9, strap connectors comprise O-rings 170, 172, 174, 176, 180, 182, 184, 186 that cooperate with carabiners 171, 173, 175, 177, 181, 183, 185, 187.

Straps may comprise any resilient strap material such as modified yoga straps, cotton straps, gate belt straps, or low-stretch nylon tricot. For example, straps may comprise modified yoga straps that are approximately 44 inches×1.5 inches with a strength rating of 500 lbs. (2.22 kN), and the straps may permanently attach to 2.5 inch diameter stainless steel O-rings by wrapping the end of each strap over the O-ring and stitching, adhering, or bonding it to itself to create a channel through which the O-ring passes. A small carabiner with a sufficient strength rating then attaches to the O-ring and can attach to any of the loops on one of the plurality of attachment loops 120, 122. A carabiner is preferred for attaching the strap to the loops on attachment loops 120, 122 because it can be easily secured or removed. While a quick release method of attaching the straps is preferred, in some cases a permanent attachment can be used or one that takes additional time to secure and remove.

In general, the safety straps are important to make the apparatus accessible to paraplegics, other disabled persons, and anyone who may need additional support during suspension therapy. The number of safety straps needed depends on how apparatus 10 will be used. For use with movement therapy or yoga, preferably three straps are available and more preferably four straps are available. Additionally, the straps can be identified as front safety straps 150, 152 and back safety straps 160, 162 based on whether they are primarily used to support a patient's front or back when sitting or laying in hammock 100. The safety straps are repositionable to accommodate different users and able to be removed quickly in case of emergency or if the patient does not need the maximum amount of support.

Figure 6:
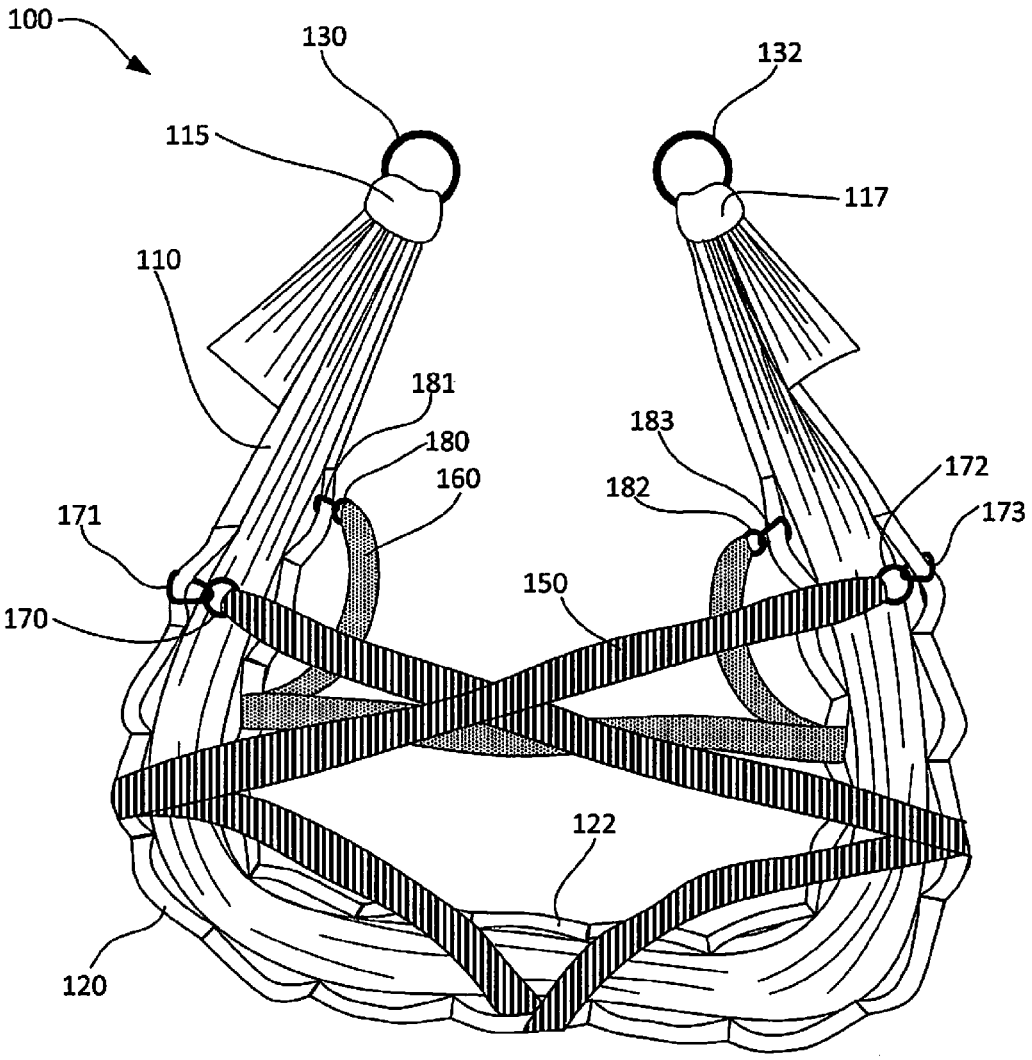
FIG. 6 is a perspective view of a first strap arrangement according to the present invention.
Figure 7:
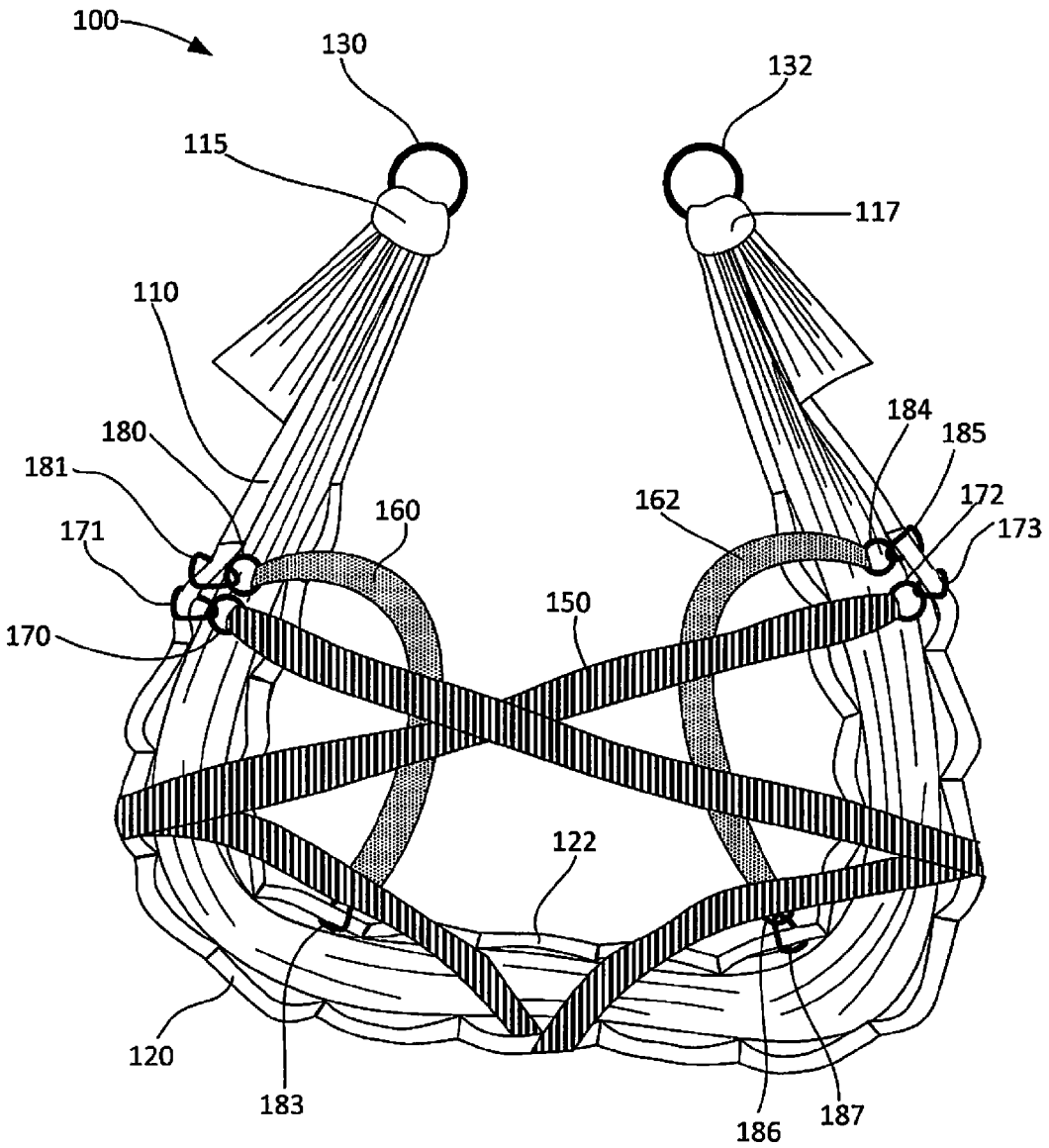
FIG. 7 is a perspective view of a second strap arrangement according to the present invention.
Figure 8:
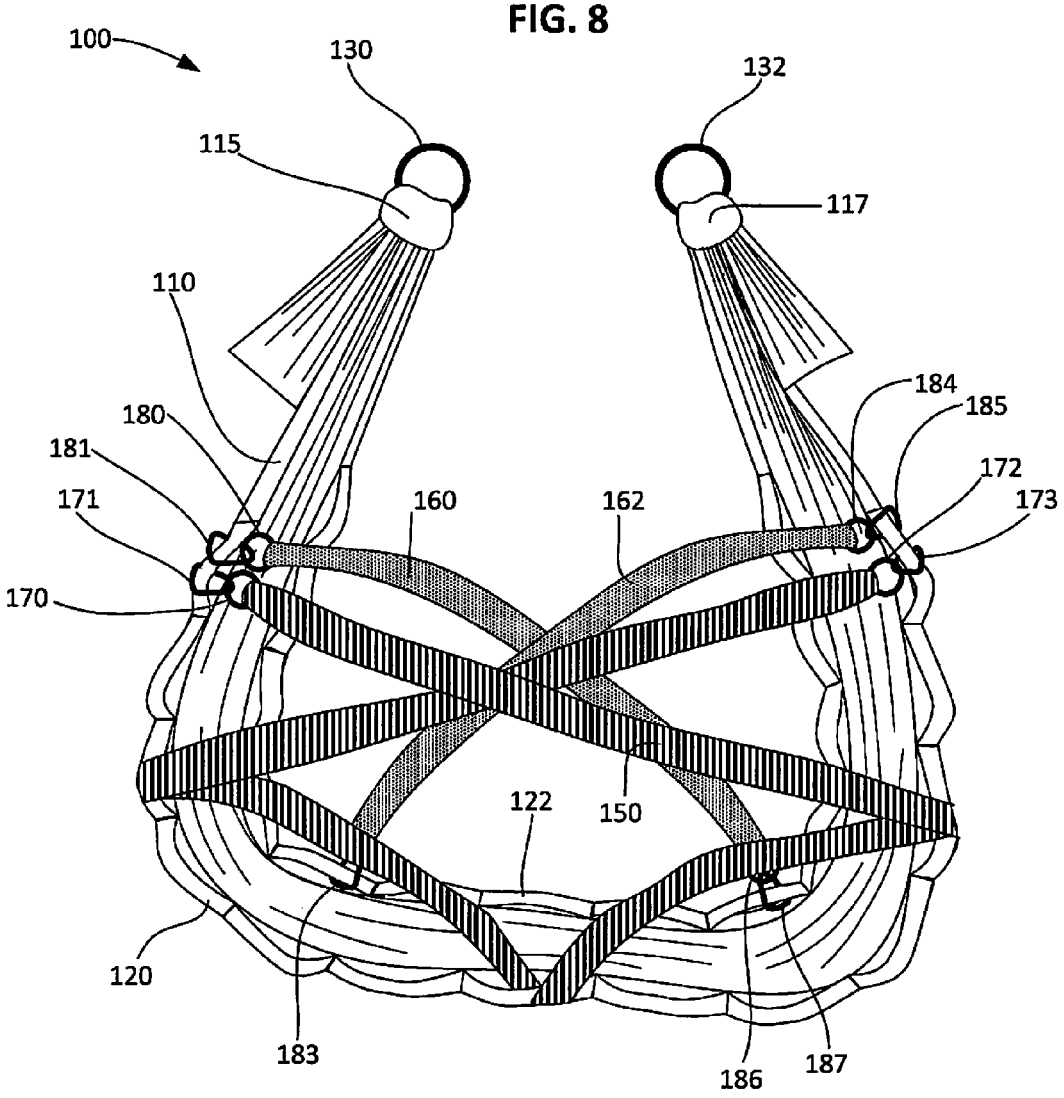
FIG. 8 is a perspective view of a third strap arrangement according to the present invention.
Figure 9:
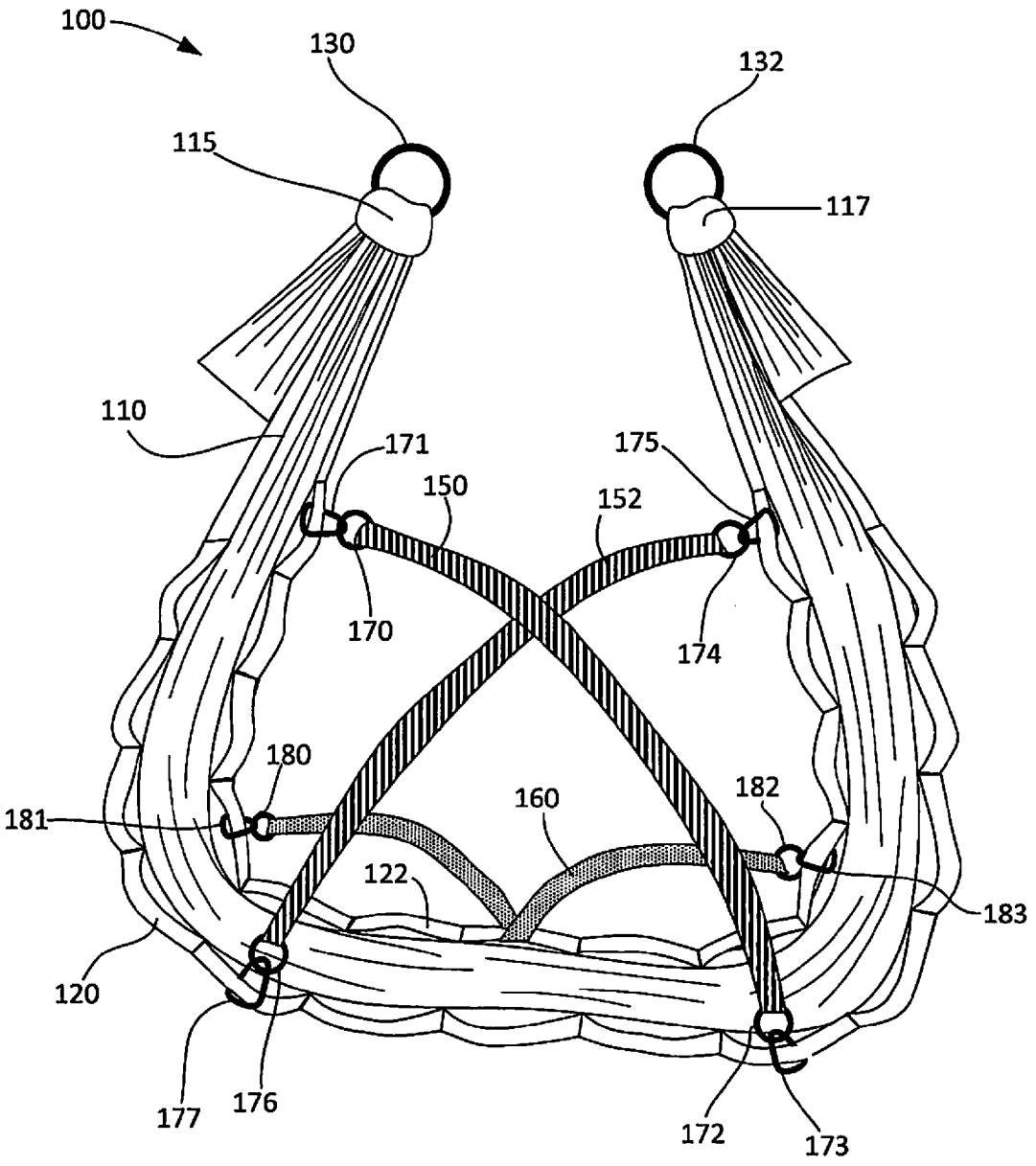
FIG. 9 is a perspective view of a fourth strap arrangement according to the present invention.

One or more safety straps 150, 152, 160, 162 are configured to weave through and/or removably attach to loops among the plurality of the attachment loops 120, 122 in several different arrangements or patterns as needed. Safety straps 150, 152, 160, 162 can be attached and detached based on the specific needs of the patient. For example, while seated upright, the patient will have safety straps both in front and behind them. FIG. 6 illustrates one method of arranging the straps where strap 160, which is behind the patient, crosses behind the patient's lower back and then crosses over his shoulders so if the patient were to fall back he would be safe while also allowing the patient to perform back stretches and move unrestricted by the straps while upright. In the front, strap 150 loops through an attachment loop between the patient's legs and then loops through again near the hips. Next, strap 150 crosses in front of the torso and clips onto loops near the shoulders. FIGS. 7-9 illustrate additional arrangements for the safety straps.

While lying on the stomach, support is less necessary but still useful. One of the straps can be attached in the same way around the patient's legs as it was in the front while the patient was seated upright. The hammock can be adjusted to end at any point along the patient's legs and the straps can still be connected in the same arrangement but lower on the legs. In the front, the straps may be connected to the back loops, crossed over the patient's back and connected near the patient's armpits in the front. If more support is needed, the yoga silk also may be pulled further under the patient's torso.

When a patient lays on his back for therapy, support may be necessary in either the front or the back. As needed, the straps may be connected in the same fashion as described above for the upright position. All of these attachment designs may still be forgone or modified depending on the individual who is using the hammock. Moreover, for all strap configurations, the straps can connect at different loops, which makes the straps highly customizable to accommodate patients or users of different heights and weights.

Figure 10:
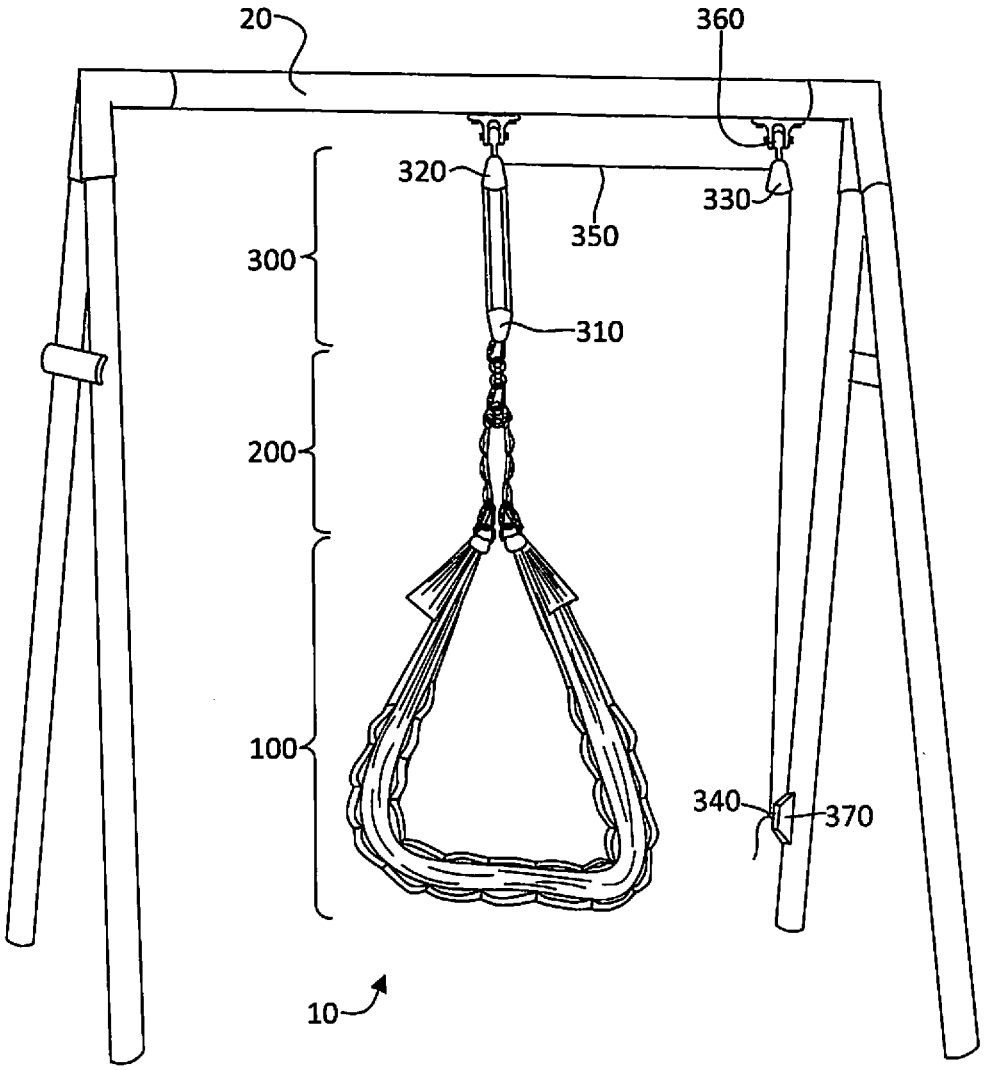
FIG. 10 is a perspective view of the hammock suspended from a frame with a pulley system according to the present invention.

An optional additional feature of apparatus 10 is a pulley system 300 that allows a therapist to raise and lower the hammock as needed. Pulley system 300 comprises a pair of double pulleys 310, 320, a rope 350, and a single pulley 330, as shown in FIG. 10. Preferably, pulley system 300 also includes an anchor 340. More preferably, pulley system 300 also includes a motor 370 that cooperates with rope 350 to cause the hammock to raise and lower accordingly. Double pulley 310 cooperates with suspension hardware 200, and double pulley 320 cooperates with the mount 210 and swing hardware 205. Single pulley 330 is offset from the double pulleys 310, 320, and preferably fixedly attaches to support 20 with a mount 360. Rope 350 attaches at one end to double pulley 310 and weaves around and through each of the pulleys as is shown in FIG. 10 and as is known in the art. Where pulley system 300 does not include a motor, a therapist can manually pull on the rope or release the rope to raise and lower a patient sitting in hammock 100 and secure the rope to anchor 340 when the patient is at the desired height from the ground. Where pulley system 300 includes motor 370, the therapist can operate motor 370 to cause the rope to shorten or lengthen. Motors 370 that cooperate with pulley systems are well known in the art.

Figure 11:
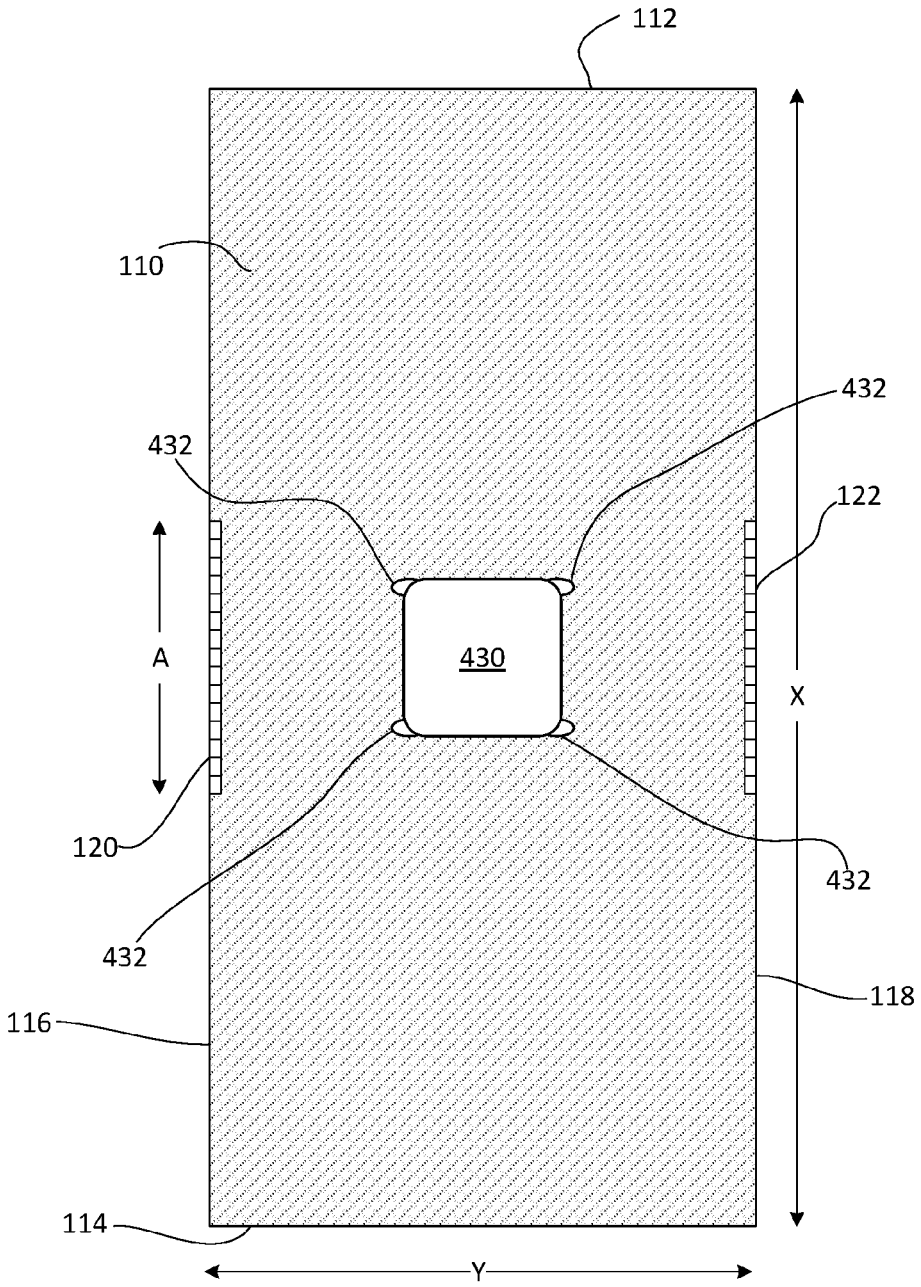
FIG. 11 is an illustration of a second embodiment of the textile of the present invention.
Figure 12:
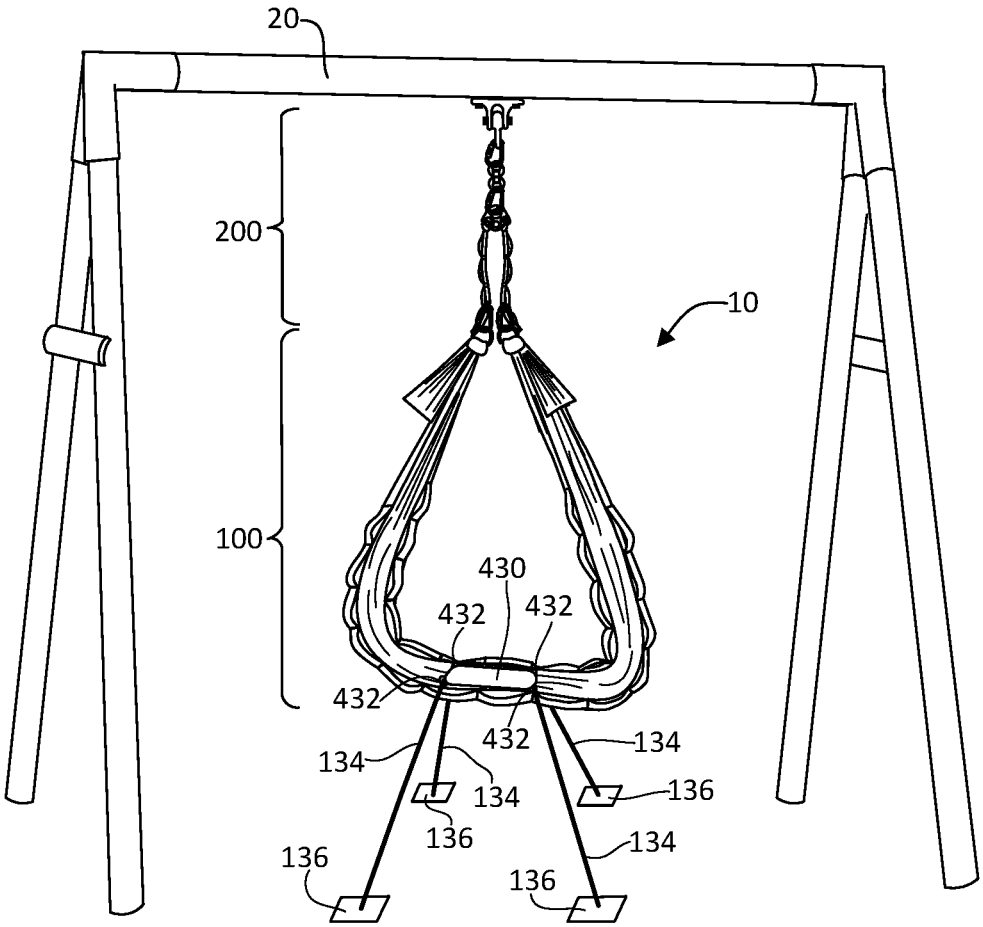
FIG. 12 is a perspective view of the hammock as formed by the second embodiment of the textile of the present invention and as anchored to the ground according to an additional embodiment of the present invention.

Additional optional features of apparatus 10 are shown in FIGS. 11 and 12 and include an integrated, fixed, or removable seat 430 that is suitable for creating a defined sitting area and optional anchor loops 432 for securing the hammock with ties to fixed points on the ground, support 20, or another location. Seat 430 may be made from a rigid material like plastic or a flexible material like neoprene depending on what is preferred with respect to comfort and ease of use. For example, a flexible material will increase the patient's comfort while a rigid material will better assist the therapist when placing a patient in hammock 100. Anchor loops 432 can be present with or without seat 430 and can be placed on either surface of textile 110. Anchor loops preferably comprise a strong material such as nylon and are permanently affixed to textile 100. Ropes or straps 134 can be tied or clipped to anchor loops 432 and also to additional anchor locations 136 on the ground or on the support to hold hammock 100 steady when helping a patient get in or out of hammock 100. FIG. 12 illustrates how hammock 100 can be secured to the ground using anchor loops 432.

To safely use apparatus 10 with a wheelchair-bound patient requiring the maximum amount of support, the following procedure is recommended for seated exercises and for exercises where the patient lays on his back:

1. Therapist attaches hammock 100 and suspension hardware 200 to the swing hardware 210 at appropriate height using the orientation in either FIG. 3 or 4.
2. Therapist orients the patient's wheelchair directly under the swing hardware 210 and drapes the hammock 100 behind the patient.
3. Patient wraps hands around the upper parts of hammock 100 and uses his arms and core to pull himself off the chair and into a seated position on hammock 100 with the help of the therapist.
4. Therapist or patient adjusts fabric to the desired position and amount of back and leg support.
5. Therapist or patient attaches straps 150, 152, 160 and/or 162 in one of the configurations from FIGS. 6-8 shown below.
6. Once the patient is secure, therapist removes the wheelchair.
7. Therapist leads patient through exercises involving sitting upright or laying on his/her back or therapist leads patient through a series of movements or a dance.
8. When done with exercises or movements, therapist positions the wheelchair back under the patient.
9. Therapist or patient detaches the straps from hammock 100.
10. Patient wraps his hands around upper part of hammock 100 and lifts himself up and out of the apparatus with the assistance of the therapist.
11. Therapist detaches apparatus 10 from the swing hardware 210.

To safely use apparatus 10 with a wheelchair-bound patient requiring the maximum amount of support, the following procedure is recommended for exercise where the patient lays on his stomach:

1. Therapist attaches hammock 100 and suspension hardware 200 to the swing hardware 210 at appropriate height using the orientation in either FIG. 3 or 4.
2. Therapist orients the patient's wheelchair directly under the swing hardware 210 and positions hammock 100 across the pelvis of the patient.
3. With the assistance of the therapist and, where needed an additional therapist, have the patient pull himself forward on to hammock 100 such that he is laying on his stomach.
4. Therapist spreads silk to the desired length under the legs and torso of patient
5. Therapist or patient attaches the straps as detailed in FIG. 9 shown below.
6. Therapist leads patient through exercises involving laying on his stomach or a series of movements or a dance.
7. Therapist or patient detaches straps from hammock 100.
8. Therapist lowers hammock 100 to the patient's pelvis.
9. Therapist positions the wheelchair behind the patient.
10. Patient wraps his hands around the upper parts of hammock 100 and pulls himself up as therapist helps moves the wheelchair underneath the patient.
11. Patient lowers himself into the wheelchair.
12. Therapist detaches apparatus 10 from the swing hardware 210.

While there has been illustrated and described what is at present considered to be the preferred embodiment of the present invention, it will be understood by those skilled in the art that various changes and modifications may be made and equivalents may be substituted for elements thereof without departing from the true scope of the invention disclosed, but that the invention will include all embodiments falling within the scope of the claims.

I claim:

1. A suspension therapy apparatus comprising:

a. A hammock comprising a flexible textile, a first plurality of attachments loops positioned along an edge of the flexible textile, a second plurality of attachment loops positioned along an edge of the flexible textile, a first suspension point positioned on an edge of the flexible textile, and a second suspension point positioned at an edge of the flexible textile;

b. A mount secured to a support;

c. Suspension hardware positioned between the hammock and the mount and configured to removably attach the first and second suspension points of the hammock to the mount; and d. One or more safety straps, wherein each safety strap comprises strap material and at least one strap connector attached to the strap material, wherein the strap material is configured to weave through one or more loops among the first or second plurality of attachment loops, and wherein the strap connector is configured to removably attach to one or more loops among the first or second plurality of attachment loops; wherein the suspension hardware comprises at least one swivel; wherein the mount comprises swing hardware; and wherein the suspension therapy hardware further comprises a spreader plate defining two or more openings, a first carabiner positioned between the swivel and the spreader plate and configured to removably attach the spreader plate to the swivel, a second carabiner positioned between the spreader plate and the hammock and configured to removably attach the spreader plate to the first suspension point of the hammock, a third carabiner positioned between the spreader plate and the hammock and configured to removably attach the spreader plate to the second suspension point of the hammock, and a fourth carabiner positioned between the swivel and the mount and configured to removably attach the swivel to the swing hardware.

2. The suspension therapy apparatus of claim 1 wherein the textile is rectangular in shape and the four edges comprise a first long edge, a second long edge, a first short edge, and a second short edge.

3. The suspension therapy apparatus of claim 2 wherein the first plurality of attachment loops is positioned along the first long edge, wherein the second plurality of attachment loops is positioned along the second long edge, wherein the first suspension point is positioned near the first short edge, and wherein the second suspension point is positioned near the second short edge.

4. The suspension therapy apparatus of claim 3 wherein the first suspension point comprises a ring, wherein the textile is secured to the first ring near its second short edge with a series of overhand knots, wherein the second suspension point comprises a second ring, and wherein the textile is secured to the second ring near the second short edge with a series of overhand knots.

5. The suspension therapy apparatus of claim 1 wherein the first plurality of attachment loops comprises at least ten individual loops arranged in a series and wherein the second plurality of attachment loops comprises at least ten individual loops arranged in a series.

6. The suspension therapy apparatus of claim 5 comprising a first safety strap and a second safety strap, wherein each of the first and second safety straps comprises two strap connectors and wherein the strap connectors are positioned near opposite ends of the strap material.

7. The suspension therapy apparatus of claim 6 further comprising a third safety strap, wherein the third safety strap comprises two strap connectors and wherein the strap connectors are positioned near opposite ends of the strap material.

8. The suspension therapy apparatus of claim 7 further comprising a fourth safety strap, wherein the fourth safety strap comprises two strap connectors and wherein the strap connectors are positioned near opposite ends of the strap material.

9. The suspension therapy apparatus of claim 1 further comprising a pulley system attached to the suspension hardware and the mount, wherein the pulley system is configured to raise and lower the hammock.

10. The suspension therapy apparatus of claim 9 wherein the pulley system comprises a first double pulley attached to the suspension hardware, a second double pulley attached to the mount, a single pulley attached to the support, and a rope strung through the first double pulley, the second double pulley, and the single pulley, wherein the rope is strung through the pulleys such that it facilitates raising and lowering the hammock when the rope is pulled or released.

11. The suspension therapy apparatus of claim 1 further comprising a seat attached to the textile substantially near the center of the textile.

12. The suspension therapy apparatus of claim 1 further comprising one or more anchor loops attached to a surface of the textile.

13. The suspension therapy apparatus of claim 11 further comprising one or more anchor loops attached to the seat.

14. A suspension therapy apparatus comprising:

a. A hammock comprising:
   i. A substantially rectangular-shaped flexible textile comprising a first long edge, a second long edge, a first short edge, and a second short edge;
   ii. a first plurality of attachments loops positioned along the first long edge of the flexible textile;
   iii. a second plurality of attachment loops positioned along the second edge of the flexible textile;
   iv. a first suspension point positioned near the first short edge of the flexible textile;
   v. a second suspension point positioned near the second short edge of the flexible textile; and
   vi. one or more or more anchor loops attached to a surface of the textile, the one or more anchor loops being configured to secure the hammock to a ground surface;

b. A mount secured to a support comprising a swing hanger;

c. Suspension hardware comprising a swivel, wherein the suspension hardware is positioned between the hammock and the mount and configured to removably attach the first and second suspension points of the hammock to the swing hanger; and d. Two or more safety straps, wherein each safety strap comprises strap material, a first strap connector attached to a first end of the strap material, and a second strap connector attached to the second end of the strap material, wherein the strap material is configured to weave through one or more loops among the first or second plurality of attachment loops, and wherein each of the strap connectors is configured to removably attach to one or more loops amount the first or second plurality of attachment loops.

15. The suspension therapy apparatus of claim 14 further comprising a pulley system attached to the suspension hardware and the mount, wherein the pulley system is configured to raise and lower the hammock.

16. The suspension therapy apparatus of claim 14 further comprising a seat attached to the textile substantially near the center of the textile.

* * * * *